US007320266B1

(12) United States Patent
Mueller

(10) Patent No.: US 7,320,266 B1
(45) Date of Patent: Jan. 22, 2008

(54) SHOCK DAMPENING COUNTERBALANCED HANDLE

(76) Inventor: Kristopher Joseph Mueller, 7 Pine Ridge Rd., Asheville, NC (US) 28804

( * ) Notice: Subject to any disclaimer, the term of this patent is extended or adjusted under 35 U.S.C. 154(b) by 0 days.

(21) Appl. No.: 11/591,055

(22) Filed: Nov. 2, 2006

(51) Int. Cl.
*B25D 1/12* (2006.01)
*B25D 1/00* (2006.01)

(52) U.S. Cl. ..... 81/22; 81/20

(58) Field of Classification Search ..... 81/22, 81/489, 20

See application file for complete search history.

(56) References Cited

U.S. PATENT DOCUMENTS

| | | | | |
|---|---|---|---|---|
| 1,304,647 | A | 5/1919 | Basta | |
| 2,603,260 | A * | 7/1952 | Floren | 81/22 |
| 4,039,012 | A | 8/1977 | Cook | 145/29 |
| 4,936,586 | A | 6/1990 | Van Raemdonck | 273/73 |
| 5,289,742 | A | 3/1994 | Vaughan, Jr. | 81/22 |
| 5,704,259 | A * | 1/1998 | Riehle | 81/22 |
| 5,911,795 | A * | 6/1999 | Tucker | 81/22 |
| 5,916,338 | A | 6/1999 | Bergkvist et al. | 81/22 |
| 6,128,977 | A | 10/2000 | Gierer et al. | 81/22 |
| 6,370,986 | B1 | 4/2002 | Scott | 81/22 |
| 6,755,096 | B2 * | 6/2004 | Schroder | 81/20 |
| 6,763,747 | B1 | 7/2004 | Gierer et al. | 81/489 |
| 6,874,186 | B2 | 4/2005 | Lin | 7/144 |
| 7,178,428 | B2 * | 2/2007 | Schroder | 81/20 |
| 2003/0029278 | A1 * | 2/2003 | Macioce et al. | 81/22 |

* cited by examiner

*Primary Examiner*—David B. Thomas
(74) *Attorney, Agent, or Firm*—Jacobson Holman PLLC

(57) ABSTRACT

Shock dampener incorporated into a hammer handle. Using a counter weight attached with a hinge pin to provide extreme shock dampening when striking solid objects with a hammer tool. Shock travels in waves known as vibration. When striking an object with the hammer's head, a shock wave is created and travels down the handle. The shock wave travels through the whole hammer handle at one time in an instant. This allows for energy of the shock to transfer into the counterbalance dampener hinge pin and vibrate the dampening member that is buffered with a form of rubber diffusing 95% of the shock energy with the dampening member.

3 Claims, 4 Drawing Sheets

SHOCK DAMPENING COUNTERBALANCED HANDLE

FIELD OF INVENTION

This invention relates to a wide scope and application of this design for a handle. This present invention spans across sports, trades, hobbies and more. The handle is represented as a hammer handle. However it will be shown that it is a general design for a handle that is and can be used in a sledge hammer, tennis racket, golf club, baseball bat and all other objects that use a handle and strikes, hits, and comes in contact with another object or surface at a high speed and/or great pressure.

PRIOR ART

U.S. Pat. Nos.
1,304,647
4,039,012
4,936,586
5,289,742
5,704,259
5,916,338
6,128,977
6,370,986
6,763,747
6,874,186

DESCRIPTION OF PRIOR ART

There are many attempts at creating a shock and vibration-dampening device in a hammer tool application. All the prior art use a different system for dampening the shock. Prior art consisting of, for example, a tuning fork, lead pellets in the head, rubber incorporated into the head or handle all create a minimal amount of true shock reduction. They may provide what is necessary for the scope and use of the specific tool however the lack of maximum amount of possible shock reduction needed in heavy duty application of using a hammer tool. Thus creating this present invention.

SUMMARY OF THE INVENTION

This invention feature is a separate piece to the main handle, this is in the shape and acts as a tuned fork and counterbalance for further vibration dampening (not specific to having the tuned fork). The counterbalance is attached to a center shaft or to the end of a solid cast handle to transfer 95% of the vibrations into the connection between the shaft and the separate tuned fork mechanism. When the head of the tool is struck against a dense object. The counterbalance mechanism and shaft is connected with a pin, most likely steel, depending on the application. The shaft, pin, and tuning fork are filled and surrounded with soft rubber or a dense rubber material depending on the application. Polypropylene or thermoplastic elastomer ect. and has a fiber mixed into the rubber to create an extremely resilient and pliable handle with incredible vibration dampening qualities. All together a unique design not on the market or under patent.

DETAILED DESCRIPTION OF PREFERRED EMBODIMENTS

Figure 1:
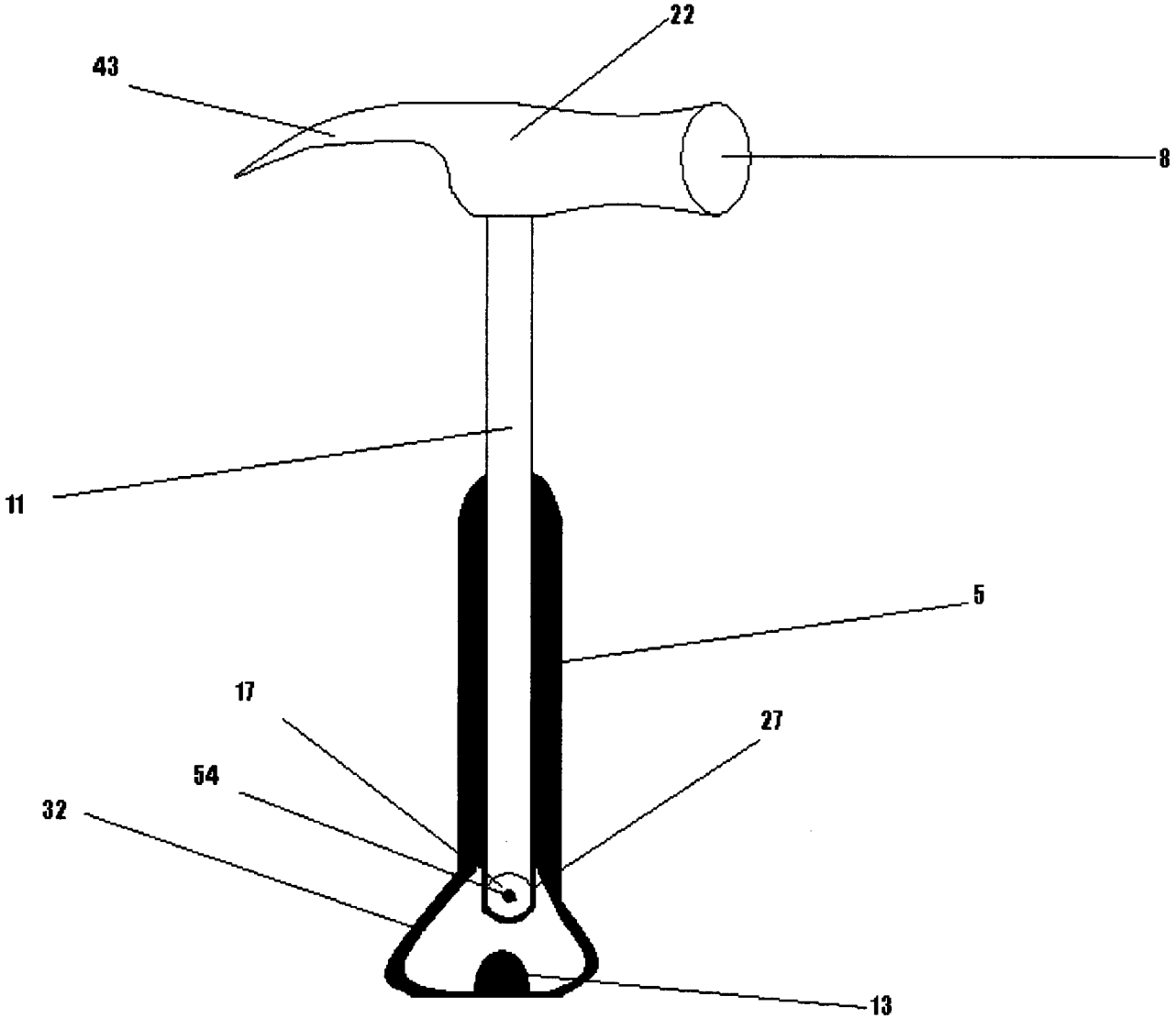
FIG. 1 Side view of one application of Preferred Embodiments

FIG. 1 is a side view of the present invention being a handle in this embodiment it has a Hammer End with a face 8 claw 43 and head 22 that is attached to a steel shaft 11 in this case could also be fiber glass, plastic, or a type of alloy depending on what the application of the present invention is applied to. The Steel Shaft 11 is encased with an exterior handle 5 in this application is a PVC and Rubber Compound to make the exterior handle 5 able to be gripped with the hand and used as a hand tool. The steel shaft 11 is connected to a counterbalance 32 in this application is of weight being 0.0001% to 1000% of the Head 22 to counterbalance while swinging this hand tool. The counterbalance 32 can be made of plastic, aluminum, alloy, steel, fiberglass depending on the scope and application of this invention. The counterbalance 32 has a counter balance hinge 17 and is fastened with a counterbalance dampener hinge pin 54 to the steel shaft 11. The counterbalance 32 has a cut at the bottom to allow for a tuned fork 13 to create further vibration dampening. The counterbalance 32 has a gap 27 in-between shaft 11 and counterbalance 32 filled or not filled with a rubber to allow for the true vibration coming from the head 22 through the steel shaft and counterbalance 32 to reduce vibration 95% when striking an object with the head 22.

Figure 2:
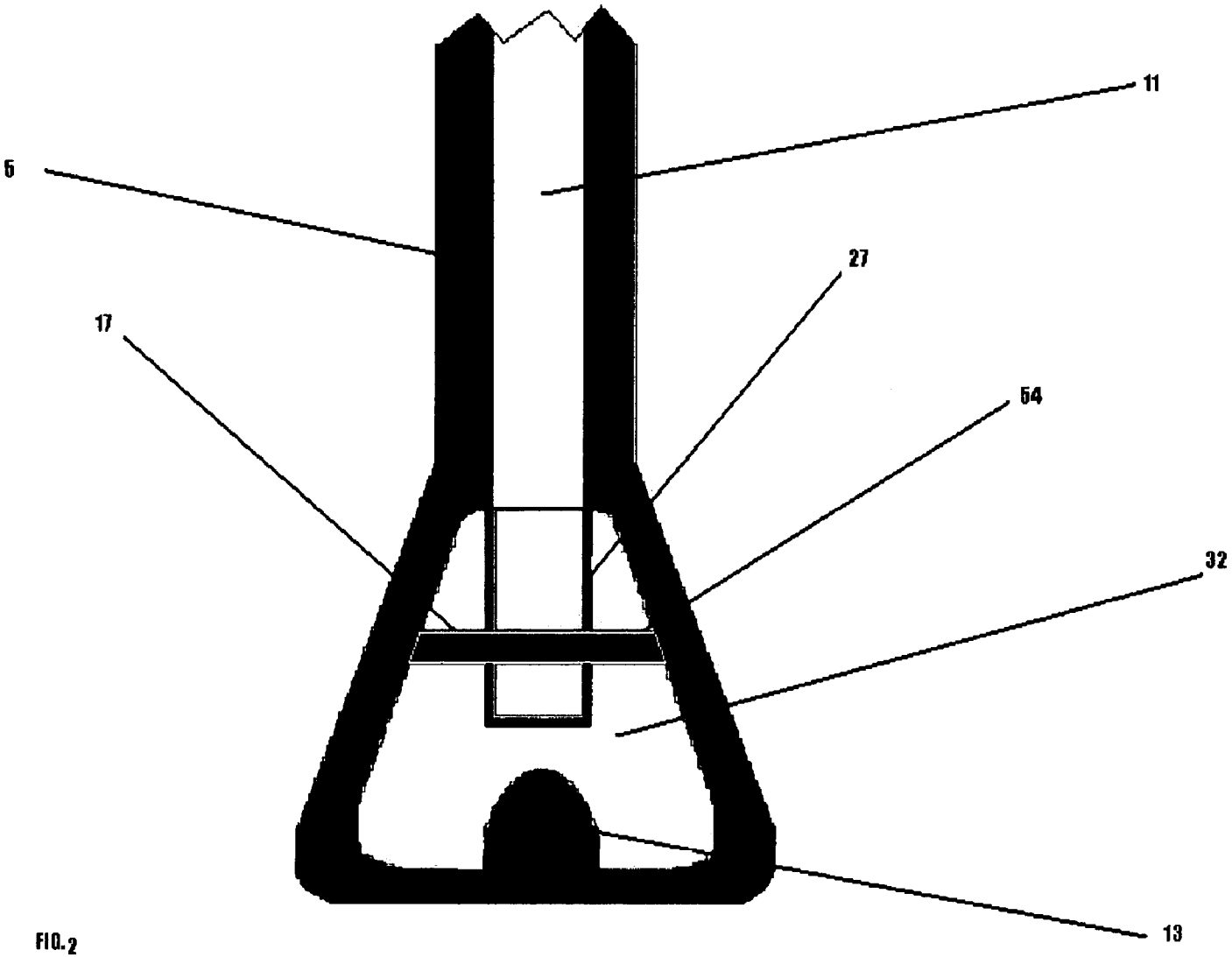
FIG. 2 Enlarged lower handle showing preferred embodiments

FIG. 2, is an enlarged lower handle showing preferred embodiments. A steel shaft 11 encased in an exterior handle 5 sliding into the counterbalance 32 fastened with a counterbalance dampener hinge pin 54 creating a counterbalance hinge 17. The steel shaft 11 slides into the counterbalance 32 having a gap 27 in-between the steel shaft 11 and counterbalance 32 allowing a little pivot creating the anti-vibration dampening system that also has cut at the bottom to allow for a tuned fork 13 further reducing vibration while striking an object with this invention.

Figure 3:
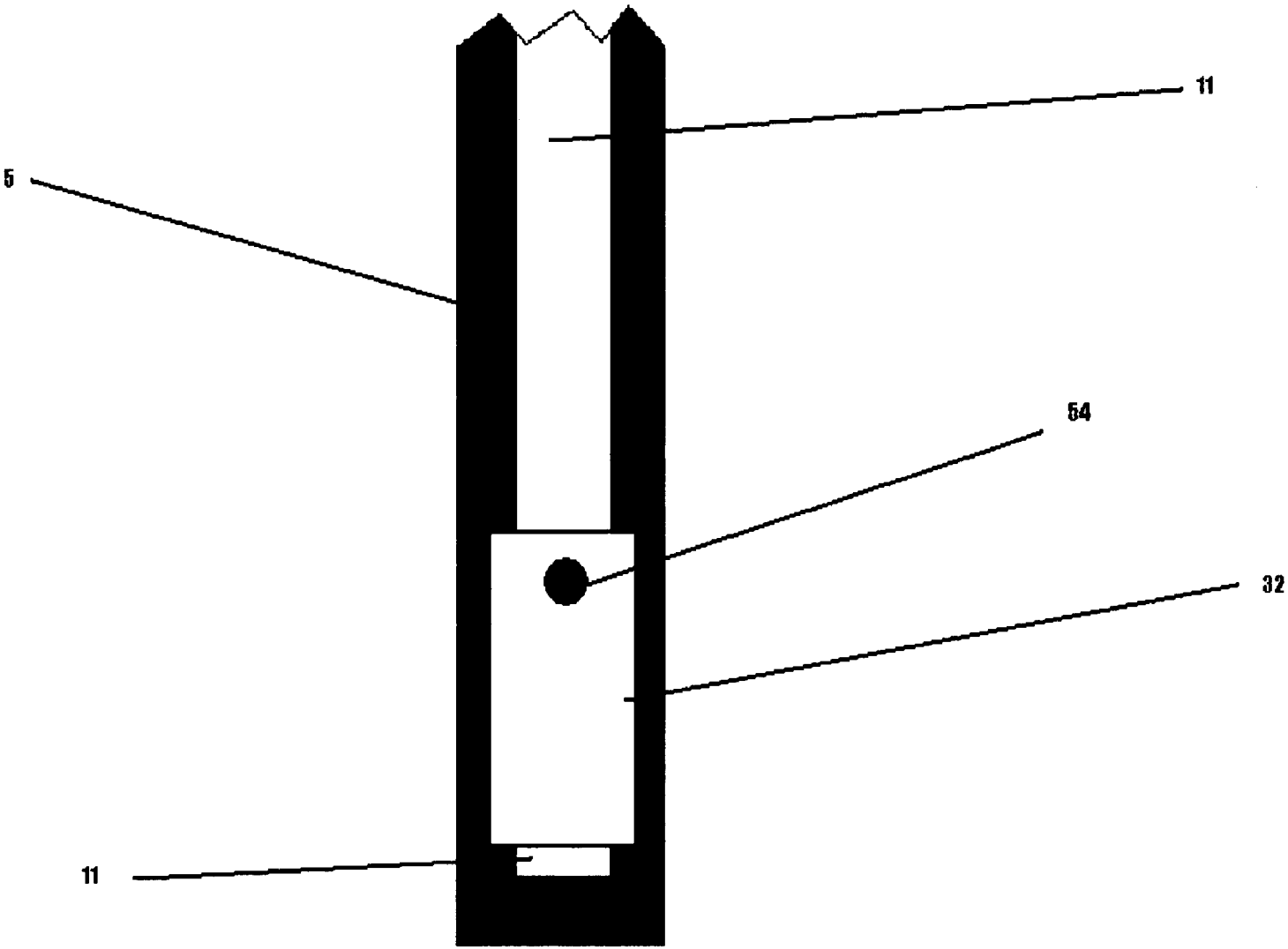
FIG. 3 Enlarged side view of the other application in present invention

FIG. 3 is an enlarged side view of the same vibration dampening invention with a different dampener 32 connected to the steel shaft 11 with the counterbalance dampener hinge pin 54 with an opening for the handle 11 to continue through. This is surrounded by a handle grip 5 for the hand to grasp.

Figure 4:
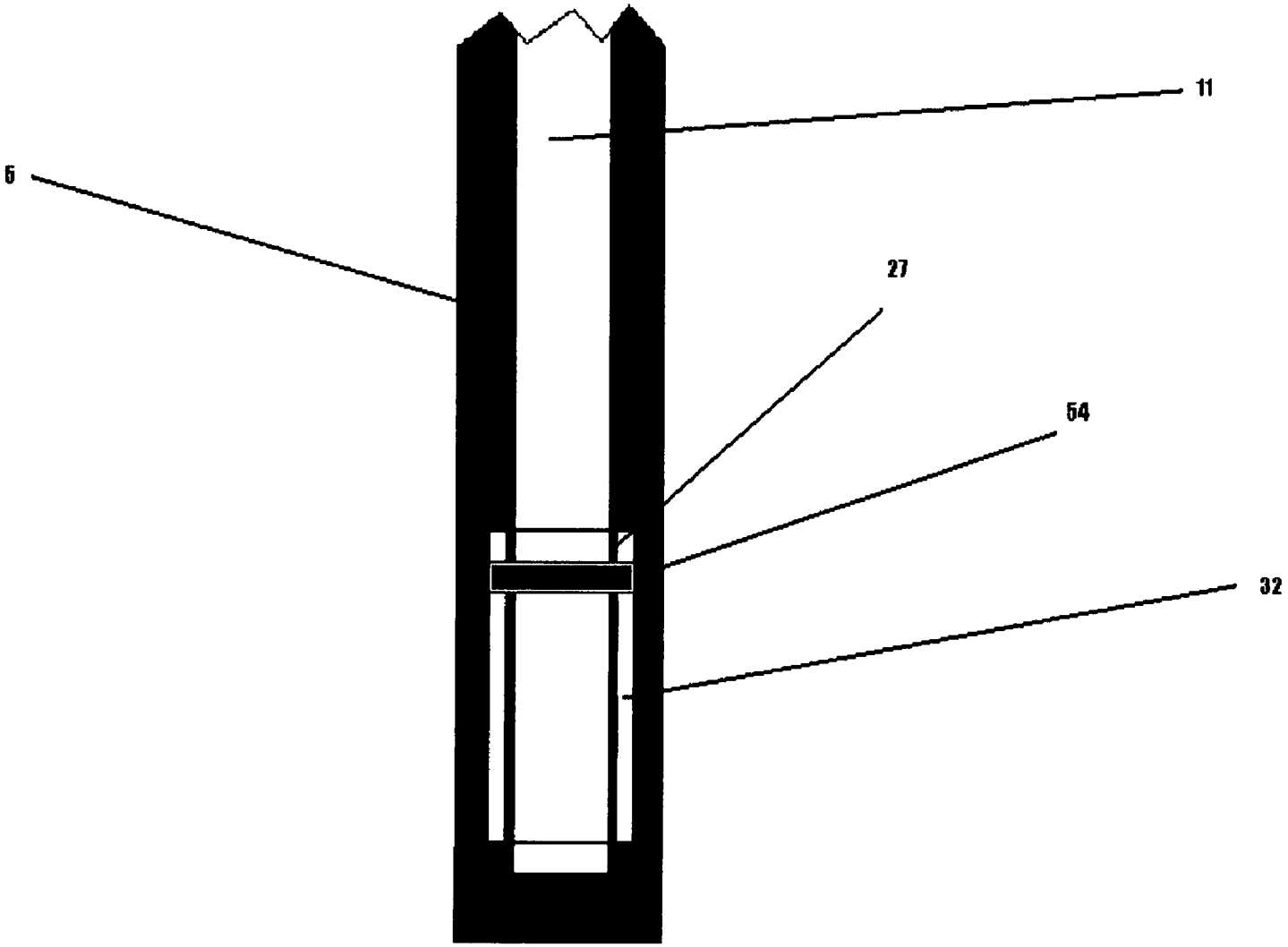
FIG. 4 Enlarged internal front view of the other application in present invention

FIG. 4 is an enlarged internal front view of the same vibration dampening invention with a different dampener 32 connected to the steel shaft 11 with the counterbalance dampener hinge pin 54 with an opening for the handle 11 to continue through. This is surrounded by a handle grip 5 for the hand to grasp. The counter balance dampener 32 has a gap 27 filled or not filled with rubber between the counter balance dampener 32 and the steel shaft 11 creating a true shock and vibration dampening system.

CONCLUSION

In conclusion this unique invention is not in a patent or in the marketplace. This invention allows the user to have a hammer that truly dampens vibration when striking an object. It can be applied in all areas of sports, sporting equipment, tennis, baseball, racquetball, hammers large and small, and multiple other handles not mentioned. With respect to the above description then it is realized that the optimum dimensional relationships for the parts of the invention to include size, materials, shape, form, function, and manner of usage, assembly and use are deemed readily apparent and obvious to one skilled in the art.

Therefore the foregoing description of the embodiments of the Invention it will be apparent that modification may be made therein. It will be understood however that these embodiments of the invention are exemplification of the invention only and that the invention is not limited thereto.

The invention claimed is:

1. A manually operable impact implement comprising a head for striking an object, a handle having two ends, said head being attached to said handle at one of said two ends, a counter balanced shock dampener member attached to the handle at the other of said two ends, a hinge pin extending through the handle and the dampener member for attaching the dampener member to said handle, a space between the dampener and the handle, and a rubber grip surrounding the handle.

2. A manually operable impact implement comprising a head for striking an object, a handle having two ends, said head being attached to said handle at one of said two ends, a counter weight located at the other of said two ends of the handle, the handle extending into the counter weight, and a space between the handle and the counter weight to receive a rubber gasket.

3. The manually operable impact implement as set forth in claim 1, wherein the handle is connected to the dampening member by a pin and the dampening member is a counter balanced shock dampener member.

* * * * *